US007303409B2

(12) United States Patent
Huang et al.

(10) Patent No.: US 7,303,409 B2
(45) Date of Patent: Dec. 4, 2007

(54) CONNECTOR AND BASE THEREOF

(75) Inventors: Ru-Kuen Huang, Taoyuan Hsien (TW); Yu-Yuan Tai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/484,581

(22) Filed: Jul. 12, 2006

(65) Prior Publication Data

US 2007/0117468 A1 May 24, 2007

(30) Foreign Application Priority Data

Nov. 23, 2005 (TW) ..... 94141107 A

(51) Int. Cl.
*H01R 12/00* (2006.01)

(52) U.S. Cl. ..... 439/83; 439/876

(58) Field of Classification Search ..... 439/676, 439/74, 75, 76.1, 876, 83, 733.1
See application file for complete search history.

(56) References Cited

U.S. PATENT DOCUMENTS

| | | | | |
|---|---|---|---|---|
| 5,116,263 | A * | 5/1992 | Bennett et al. | 439/733.1 |
| 5,516,301 | A * | 5/1996 | Kawakita | 439/206 |
| 5,607,314 | A * | 3/1997 | Chuang | 439/83 |
| 6,638,082 | B2 * | 10/2003 | Belopolsky et al. | 439/83 |
| 2004/0224564 | A1 * | 11/2004 | Wan et al. | 439/676 |
| 2005/0026509 | A1 * | 2/2005 | Chang | 439/676 |

* cited by examiner

*Primary Examiner*—Tho D. Ta
(74) *Attorney, Agent, or Firm*—Birch, Stewart, Kolasch & Birch, LLP

(57) ABSTRACT

A connector includes a base, a circuit structure and a terminal base. The base has a body and a plurality of pins, wherein a surface of the body is formed with a plurality of recesses, and the pins are respectively inserted the recesses. The circuit structure is electrically connected with the pins, and the terminal base has a plurality of terminals for electrically connecting with the circuit structure.

10 Claims, 4 Drawing Sheets

CONNECTOR AND BASE THEREOF

CROSS REFERENCE TO RELATED APPLICATIONS

This Non-provisional application claims priority under U.S.C. § 119(A) on Patent Application No(S). 094141107, filed In Taiwan, Republic of China on Nov. 23, 2005, the entire contents of which are hereby incorporated by reference.

BACKGROUND OF THE INVENTION

1. Field of Invention

The invention relates to a connector and a base thereof and more particularly to a connector and a base thereof that can prevent the short circuit issue.

2. Related Art

Generally, a connector, such as an RJ-45 connector, is applied to various network connecting interfaces for transmitting signals. Referring to FIG. 1 FIG. 1, it is a schematic view showing a conventional connector. The conventional connector 1 includes a base 10, a circuit board 11, and a terminal base 12. The circuit board 11 is disposed on the base 10, and the base 10 has a plurality of pins 101 penetrating through the base 10 to electrically connect to the external circuit. The terminal base 12 is also disposed on the base 10 and has a plurality of terminals 121, each of which is connected to a node of the circuit board 11, so that it can electrically connect to the corresponding pin 101 via the circuit layout of the circuit board 11.

The pins 101 are connected on the circuit board 11 by soldering. However, during the soldering process, the melted tin may flux to induce the short circuit issue. Moreover, since the present electronic device is small sized and has powerful functions due to the progressive electrical technology, the pitches between the pins 101 of the connector 1 are correspondingly reduced to match the trend of minimization. In this case, the short circuit issue caused by the flux tin becomes more obvious.

Therefore, it is an important subject of the invention to provide a connector and a base thereof that can prevent the short circuit issue caused by the electrical conduction between the pins.

SUMMARY OF THE INVENTION

In view of the foregoing, the invention is to provide a connector and a base thereof that can prevent the short circuit issue caused by the electrical conduction between the pins.

To achieve the above, a base of the invention includes a plurality of pins and a body. In the invention, a surface of the body is formed with a plurality of recesses. The pins are respectively inserted in the recesses, respectively.

To achieve the above, the invention also discloses a connector including a base, a circuit structure, and a terminal base. In the invention, the base includes a plurality of pins and a body, which has a surface formed with a plurality of recesses. The pins are respectively inserted in the recesses. The circuit structure is electrically connected with the pins. The terminal base has a plurality of terminals for electrically connecting with the circuit structure.

As mentioned above, the connector and base of the invention have the recesses formed on the surface of the base so that the pins can be inserted in the recesses. For example, each pin may insert into one corresponding recess. When an electronic device, such as a connector, is proceeded a welding process, the recesses can accommodate the solder, such as a melted tin. Thus, the residual tin may not be flow around. Accordingly, the short circuit issue caused by the electrical conduction between the pins can be efficiently prevented.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
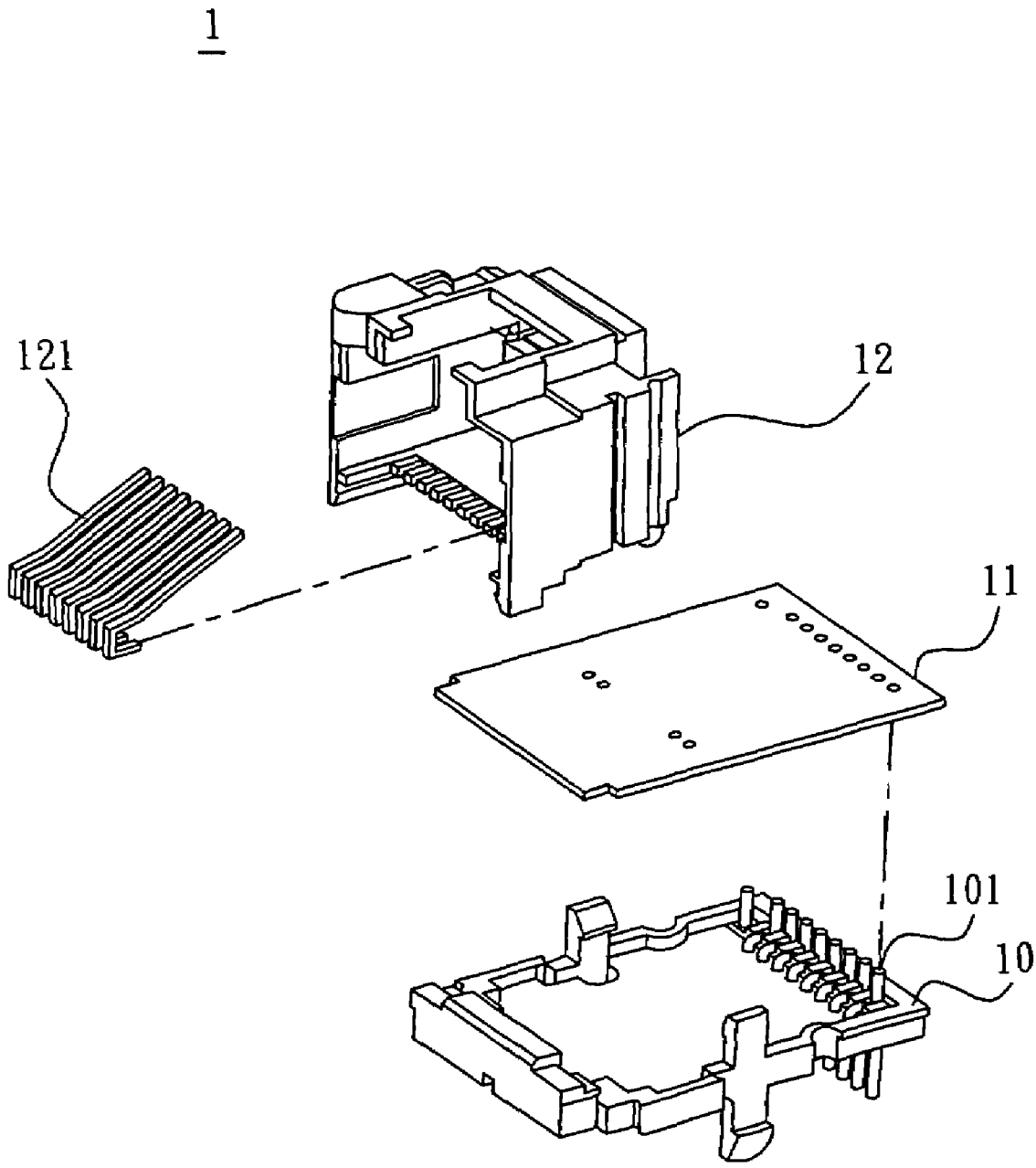
FIG. 1 (PRIOR ART)
FIG. 1 is a schematic view showing a conventional connector.
Figure 2:
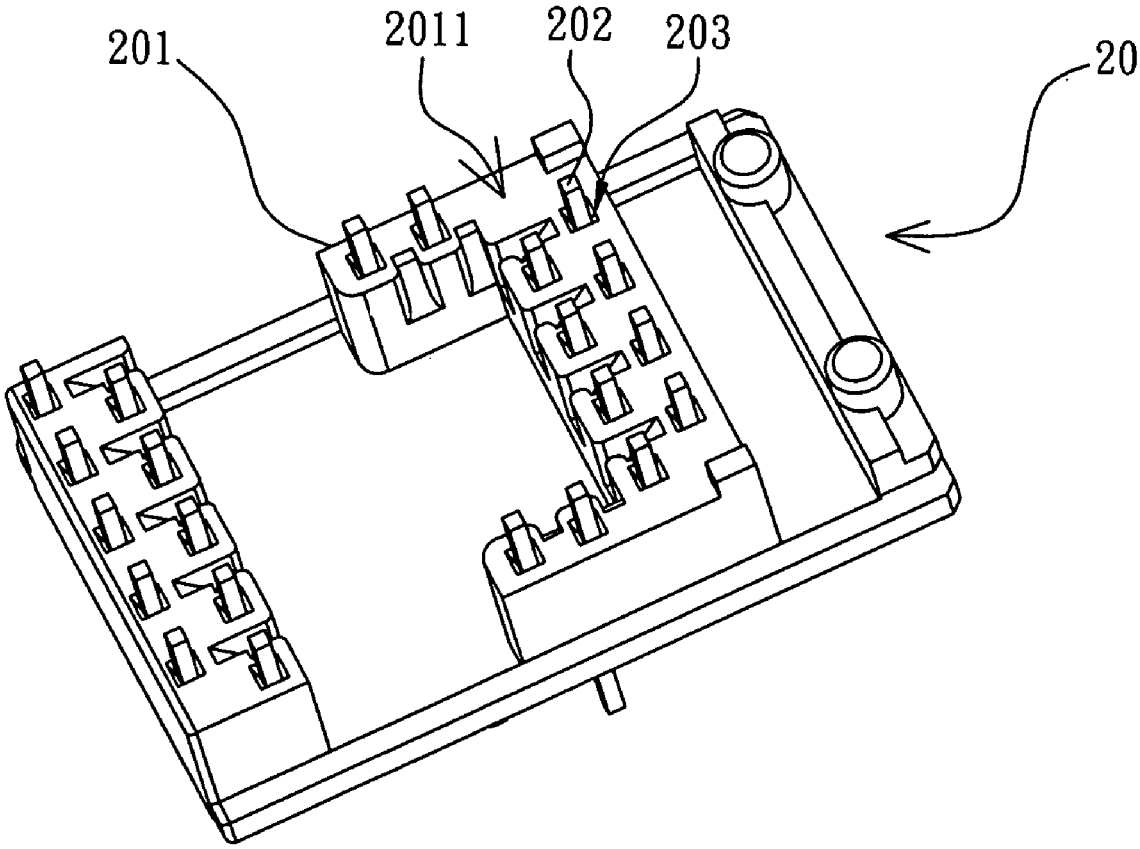
FIG. 2 is a schematic view showing a base according to a preferred embodiment of the invention.

With reference to FIG. 2, a base 20 according to a preferred embodiment of the invention includes a plurality of pins 202 and a body 201. The base 20 may be applied to an RJ-11 connector, an RJ-12 connector, an RJ-45 connector, or other connector.

The body 201 has a surface 2011, which is formed with a plurality of recesses 203. In the present embodiment, the recesses 203 are positioned corresponding to the pins 202 and are indented below the surface 2011. Alternatively, the recesses 203 may be protruded from the surface 2011. The pins 202 are respectively inserted into the recesses 203. The cross section of each recess 203 is relatively larger than that of the corresponding pin 202. In this embodiment, the number of the recesses 203 corresponds to that of the pins 202. A solder may be applied into the recesses 203 for fixing the pins 202 onto the base 20. In the current embodiment, the solder is a lead-free tin.

Figure 3:
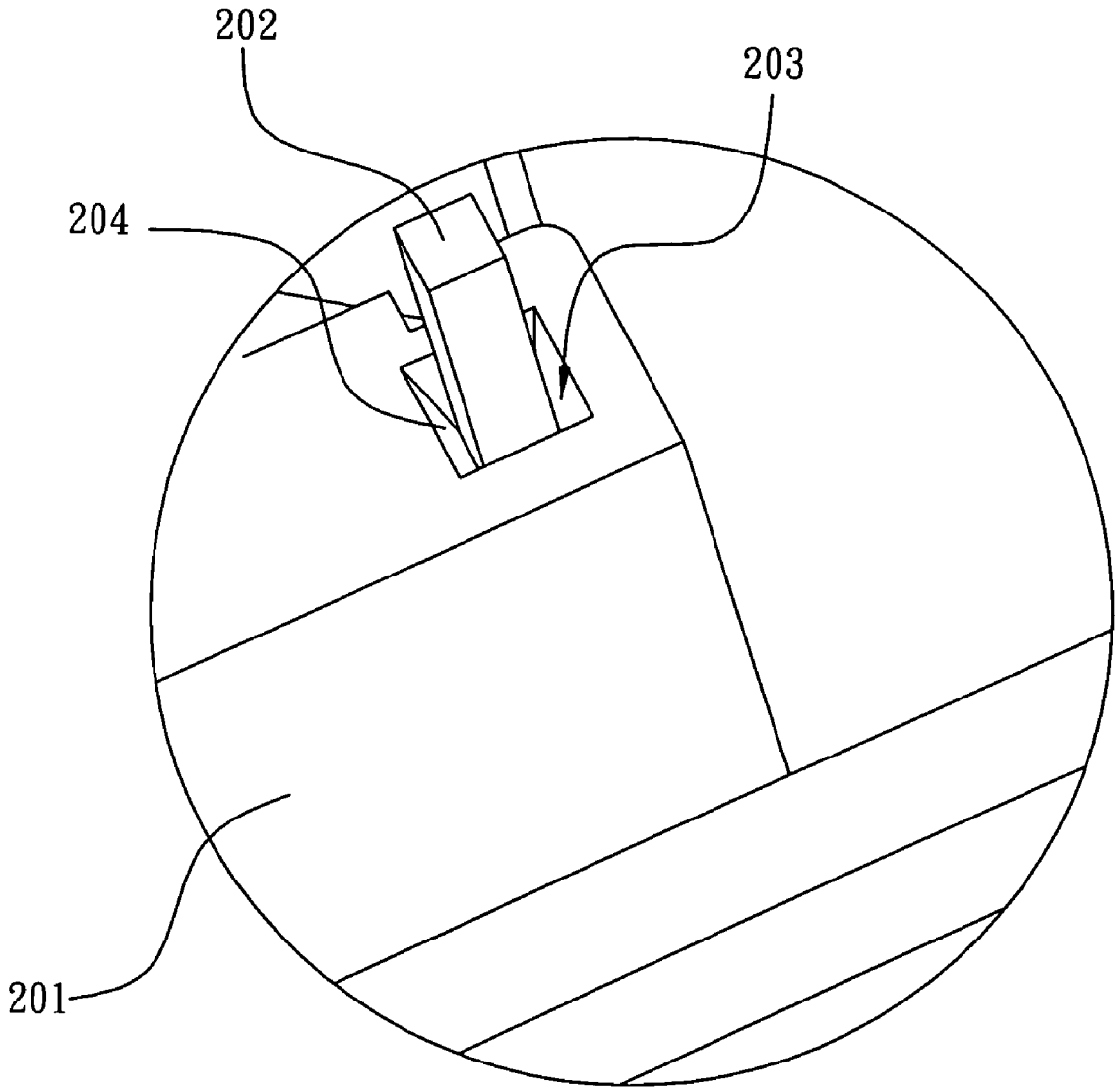
FIG. 3 is a partial enlarged view showing the base according to the embodiment of the invention.

In addition, at least one inner wall of the recess 203 has an oblique guiding surface 204. As shown in FIG. 3, the oblique guiding surface 204 is gradually tilted inwards the recess 203 from the opening of the recess 203 so as to guide the melted tin during the welding process. Accordingly, the solder (melted tin) can be guided into the recess 203 during the welding process, and the solder (melted tin) is confined to the recesses.

Figure 4:
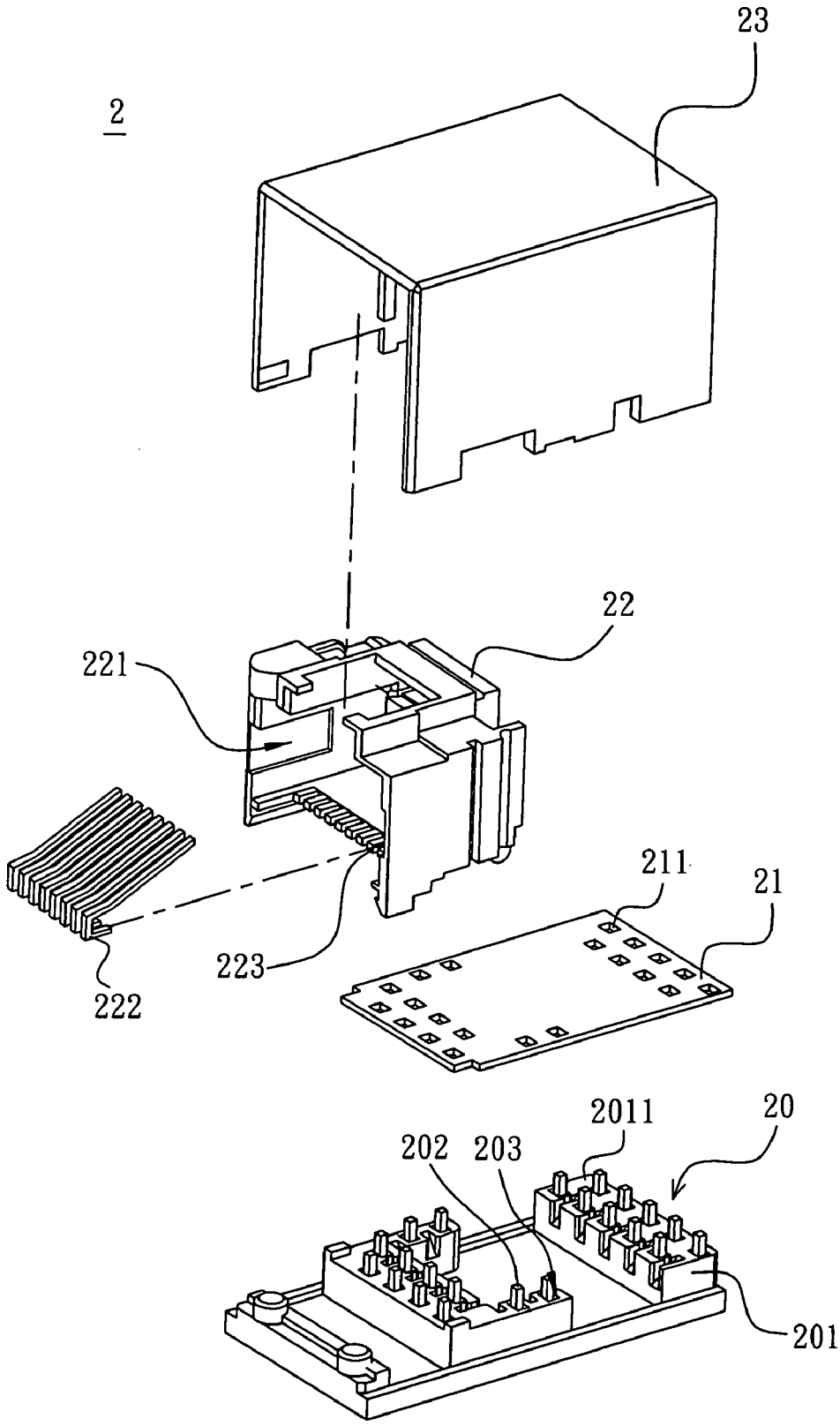
FIG. 4 is a schematic view showing a connector according to the embodiment of the invention.

With reference to FIG. 4, a connector 2 according to the embodiment of the invention includes a base 20, a circuit structure 21, and a terminal base 22. In the embodiment, the connector 2 may be an RJ-11 connector, an RJ-12 connector, an RJ-45 connector, or other connector.

The base 20 includes a plurality of pins 202 and a body 201. To be noted, the structures and functions of the elements of the base 20 are the same as those disclosed in the previous embodiment, so the detailed descriptions are omitted for concise purpose.

In this embodiment, the circuit structure 21 is disposed on the base 20 and has a plurality of pin holes 211 positioned corresponding to the pins 202. The pins 202 are inserted into the pin holes 211 for electrically connecting with the circuit structure 21. The circuit structure 21 may be electrically connected to an external circuit through the pins 202. In this case, the circuit structure 21 is a circuit board.

The terminal base 22 is connected with the base 20, and the circuit structure 21 is disposed between the terminal base 22 and the base 20.

The terminal base 22 has a slot 221 and a plurality of terminals 222. The slot 221 is located at one side of the terminal base 22 and has a plurality of fastening portions 223 disposed on the bottom of the slot 221. The terminals 222 are disposed corresponding to the fastening portions 223. The end of each terminal 222 is connected to the node of the circuit structure 21 by way of, for example, a welding process. As the result, the terminals 222 can be electrically connected with the corresponding pins 202.

The connector 2 of the embodiment further includes a housing 23 for covering the base 20, the circuit structure 21 and the terminal base 22.

As mentioned above, the connector and base of the invention have the recesses formed on the surface of the base, so that the pins can be inserted in the recesses. For example, each pin may be inserted into one corresponding recess. When an electronic device, such as a connector, is proceeded a welding process, the recesses can accommodate the melted tin. Thus, the residual tin is confined to the recesses and may not flow around. Accordingly, the short circuit issue caused by the electrical conduction between the pins can be efficiently prevented. In addition, since the oblique guiding surface is gradually tilted inwards the recess from the opening thereof, the solder can be guided into the recess during the welding process.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A base, comprising:

a plurality of pins; and a body having a plurality, of recesses formed on a surface of the body, wherein the pins are respectively disposed in the recesses which prevents a lead-free fin from flowing around the surface of the body during a soldering process;

wherein at least one inner wall of each recess has an oblique guiding surface so as to guide the melted lead-free tin into the recess and is confined to the recess and the number of the recesses corresponds to the number of pins.

2. The base of claim 1, wherein the recesses are indented below the surface or protruded from the surface.

3. The base of claim 1, wherein a cross section of each recess is relatively larger than that of the corresponding pin.

4. A connector, comprising:

a base comprising a body and a plurality of pins, wherein a surface of the body is formed with a plurality of recesses, and the pins are respectively disposed in the recesses;

a circuit structure electrically connected with the pins, the circuit structure having a plurality of pin holes positioned corresponding to the pins; and a terminal base having a plurality of terminals for electrical connecting with the circuit structure;

wherein the recesses accommodate a lead-free tin and prevent the lead-free tin from flowing around the surface of the body during a soldering process;

wherein at least one inner wall of each recess has an oblique guiding surface so as to guide the melted lead-free tin into the recess and is confined to the recess and the number of the recesses corresponds to the number of pins.

5. The connector of claim 4, wherein the circuit structure is a circuit board electrically connected with an external circuit.

6. The connector of claim 4, wherein the circuit structure is disposed between the terminal base and the base.

7. The connector of claim 4, further comprising:

a housing for covering the base, the circuit structure and the terminal base.

8. The connector of claim 4, wherein the recesses are indented below the surface or protruded from the surface.

9. The connector of claim 4, wherein a cross section of each recess is relatively larger than that of the corresponding pin.

10. The connector of claim 4, wherein the connector is RJ-11 connector, an RJ-12 connector, or an RJ-45 connector.

* * * * *